US009835011B2

(12) United States Patent
Cronley et al.

(10) Patent No.: US 9,835,011 B2
(45) Date of Patent: Dec. 5, 2017

(54) MULTI-WINDOW LATERAL WELL LOCATOR/REENTRY APPARATUS AND METHOD

(71) Applicant: Knight Information Systems, LLC, Lafayette, LA (US)

(72) Inventors: Gerald J. Cronley, Gretna, LA (US); Timothy T. Torrez, Aztec, NM (US)

( * ) Notice: Subject to any disclaimer, the term of this patent is extended or adjusted under 35 U.S.C. 154(b) by 226 days.

(21) Appl. No.: 14/146,849

(22) Filed: Jan. 3, 2014

(65) Prior Publication Data

US 2014/0190688 A1 Jul. 10, 2014

Related U.S. Application Data

(60) Provisional application No. 61/750,011, filed on Jan. 8, 2013.

(51) Int. Cl.
*E21B 41/00* (2006.01)

(52) U.S. Cl.
CPC ..... *E21B 41/0035* (2013.01)

(58) Field of Classification Search
CPC ..... E21B 41/0035; E21B 47/09
See application file for complete search history.

(56) References Cited

U.S. PATENT DOCUMENTS 2,856,007 A 10/1958 Fredd
2,941,599 A 6/1960 Daffin
3,561,535 A 2/1971 Butler et al.
3,610,336 A 10/1971 Sizer
3,713,483 A 1/1973 Robicheaux
4,074,762 A 2/1978 Parker et al.
4,103,740 A 8/1978 Yonker
4,153,109 A 5/1979 Szescila
4,182,423 A 1/1980 Ziebarth et al.
4,194,580 A 3/1980 Messenger
4,284,136 A 8/1981 Grabe
4,304,299 A 12/1981 Holland et al.
4,321,965 A 3/1982 Restarick et al.
4,365,668 A 12/1982 Bright
4,449,595 A 5/1984 Holbert
(Continued)

*Primary Examiner* — Jennifer H Gay

(57) ABSTRACT

An apparatus and method for locating multiple windows in a wellbore. The windows are associated with lateral wells. The apparatus may include: a running tool connected to a work string, wherein the running tool contains an inner bore being located at a distal end of the running tool; a swing arm having a locating head, the swing arm being pivotally attached within an inner cavity in the running tool, wherein the locating head has a retracted position within the running tool and an extended position extending from the running tool, and wherein the locating head has a shearing surface at an aft end; a biasing member disposed within the inner bore, the biasing member configured to create a force in the direction of the locating head; a shearing rod operatively positioned within the inner bore and engaging a first end of the biasing member so that the shearing rod extends from the inner bore in the direction out of the inner bore towards the locating head, wherein the shearing rod contains a series of individual grooves; and wherein the shearing surface is configured to engage and shear the individual grooves of the shearing rod at a predetermined force in multiple, individual cycles.

33 Claims, 8 Drawing Sheets

(56) References Cited

U.S. PATENT DOCUMENTS

| | | | |
|---|---|---|---|
| 4,665,995 | A | 5/1987 | Braithwaite et al. |
| 4,693,327 | A | 9/1987 | Dickinson et al. |
| 4,742,871 | A | 5/1988 | Miffre |
| 4,762,186 | A | 8/1988 | Dech et al. |
| 4,807,704 | A | 2/1989 | Hsu et al. |
| 4,819,760 | A | 4/1989 | Petermann |
| 4,928,767 | A | 5/1990 | Jelsma |
| 5,109,924 | A | 5/1992 | Jurgens et al. |
| 5,113,938 | A | 5/1992 | Clayton |
| 5,131,467 | A | 7/1992 | Osborne et al. |
| 5,188,190 | A | 2/1993 | Skaalure |
| 5,193,620 | A | 3/1993 | Braddick |
| 5,195,591 | A | 3/1993 | Blount et al. |
| 5,269,374 | A | 12/1993 | Taylor |
| 5,277,251 | A | 1/1994 | Blount et al. |
| 5,311,936 | A | 5/1994 | McNair et al. |
| 5,318,122 | A | 6/1994 | Murray et al. |
| 5,318,132 | A | 6/1994 | Odorisio |
| 5,341,873 | A | 8/1994 | Carter et al. |
| 5,346,017 | A | 9/1994 | Blount et al. |
| 5,394,950 | A | 3/1995 | Gardes |
| 5,409,060 | A | 4/1995 | Carter |
| 5,425,417 | A | 6/1995 | Carter |
| 5,425,425 | A | 6/1995 | Bankston et al. |
| 5,427,177 | A | 6/1995 | Jordan et al. |
| 5,431,219 | A | 7/1995 | Leising et al. |
| 5,431,223 | A | 7/1995 | Konopczynski |
| 5,458,209 | A | 10/1995 | Hayes et al. |
| 5,488,989 | A | 2/1996 | Leising et al. |
| 5,533,573 | A | 7/1996 | Jordan et al. |
| 5,564,503 | A | 10/1996 | Longbottom et al. |
| 5,566,762 | A | 10/1996 | Braddick et al. |
| 5,592,991 | A | 1/1997 | Lembcke et al. |
| 5,651,415 | A | 7/1997 | Scales |
| 5,678,634 | A | 10/1997 | Rehbock et al. |
| 5,697,445 | A | 12/1997 | Graham |
| 5,803,176 | A | 9/1998 | Blizzard et al. |
| 5,810,080 | A | 9/1998 | Meynier |
| 5,836,387 | A | 11/1998 | Carter |
| 5,862,859 | A | 1/1999 | Speed et al. |
| 5,871,046 | A | 2/1999 | Robison |
| 5,884,698 | A | 3/1999 | Hughes et al. |
| 5,887,655 | A | 3/1999 | Haugen et al. |
| 5,909,770 | A | 6/1999 | Davis |
| 5,911,275 | A | 6/1999 | McGarian et al. |
| 5,947,201 | A | 9/1999 | Ross et al. |
| 6,003,621 | A | 12/1999 | Murray |
| 6,012,527 | A | 1/2000 | Nitis et al. |
| 6,024,169 | A | 2/2000 | Haugen |
| 6,032,740 | A | 3/2000 | Schnitker et al. |
| 6,035,939 | A | 3/2000 | Carter |
| 6,050,334 | A | 4/2000 | McGarian et al. |
| 6,076,606 | A | 6/2000 | Bailey et al. |
| 6,102,123 | A | 8/2000 | Bailey et al. |
| 6,142,225 | A | 11/2000 | McCorry et al. |
| 6,173,796 | B1 | 1/2001 | McLeod |
| 6,186,233 | B1 | 2/2001 | Brunet |
| 6,199,635 | B1 | 3/2001 | Brunet et al. |
| 6,209,635 | B1 | 4/2001 | Gotlib et al. |
| 6,244,340 | B1 | 6/2001 | McGlothen et al. |
| 6,279,659 | B1 | 8/2001 | Brunet |
| 6,315,044 | B1 | 11/2001 | Tinker |
| 6,315,054 | B1 | 11/2001 | Brunet |
| 6,334,485 | B1 | 1/2002 | George |
| 6,360,821 | B1 | 3/2002 | Braddick |
| 6,405,804 | B1 | 6/2002 | Ohmer et al. |
| 6,422,312 | B1 | 7/2002 | Delatorre et al. |
| 6,457,525 | B1 | 10/2002 | Scott |
| 6,619,400 | B2 | 9/2003 | Brunet |
| 6,679,329 | B2 | 1/2004 | Murray et al. |
| 6,695,056 | B2 | 2/2004 | Haugen et al. |
| 6,702,014 | B1 | 3/2004 | McGarian et al. |
| 6,935,431 | B2 | 8/2005 | Dewey et al. |
| 6,968,896 | B2 | 11/2005 | Coon |
| 6,968,903 | B2 | 11/2005 | Pollard |
| 7,178,589 | B2 | 2/2007 | Campbell et al. |
| 7,331,387 | B2 | 2/2008 | McGarian et al. |
| 7,422,057 | B2 | 9/2008 | Lewis et al. |
| 7,448,446 | B2 | 11/2008 | Campbell et al. |
| 7,455,110 | B2 | 11/2008 | Lynde |
| 7,980,307 | B2 | 7/2011 | Saylor, III |
| 8,316,937 | B2 * | 11/2012 | Cronley ..... E21B 41/0035 166/117.5 |
| 2002/0023745 | A1 | 2/2002 | George et al. |
| 2002/0066577 | A1 | 6/2002 | Dewey et al. |
| 2002/0074121 | A1 | 6/2002 | Schick |
| 2002/0096326 | A1 | 7/2002 | Buytaert |
| 2002/0100588 | A1 | 8/2002 | Murray et al. |
| 2002/0195243 | A1 | 12/2002 | Hart et al. |
| 2003/0070801 | A1 | 4/2003 | Harmon et al. |
| 2003/0075334 | A1 | 4/2003 | Haugen et al. |
| 2003/0150612 | A1 | 8/2003 | McGarian et al. |
| 2003/0192700 | A1 | 10/2003 | Murray et al. |
| 2006/0131011 | A1 | 6/2006 | Lynde et al. |
| 2009/0255664 | A1 | 10/2009 | Hart et al. |
| 2010/0059279 | A1 | 3/2010 | Saylor |
| 2010/0252257 | A1 | 10/2010 | Cronley et al. |
| 2010/0252275 | A1 * | 10/2010 | Cronley ..... E21B 41/0035 166/381 |
| 2014/0190688 | A1 * | 7/2014 | Cronley ..... E21B 41/0035 166/255.1 |

* cited by examiner

MULTI-WINDOW LATERAL WELL LOCATOR/REENTRY APPARATUS AND METHOD

This application claims priority from U.S. Provisional Patent Application Ser. No. 61/750,011, entitled "Multi-Window Well Locator/Reentry Apparatus and Method" filed on 8 Jan. 2013 which is incorporated herein by reference.

FIELD OF THE INVENTION

This invention relates to an apparatus and method used to locate a window in a wellbore. More specifically, but not by way of limitation, this invention relates to an apparatus and method to locate multiple windows in a wellbore.

BACKGROUND OF THE INVENTION

In today's oil and gas industry, operators are drilling multiple lateral wells from a single wellbore. The technique of drilling multiple lateral wells generally results in increased production and increased reservoir depletion. The technique may include drilling the wellbore, setting a whipstock in the wellbore, drilling a window and drilling the lateral well. Multiple lateral wells may be drilled.

After drilling a wellbore containing multiple lateral wells that extend therefrom, an operator may find it necessary to reenter the individual lateral wells to perform remedial well work such as completing, gravel packing, acidizing, fracturing, etc. A window locator and reentry apparatus was described in U.S. Pat. No. 8,316,937 issued on 27 Nov. 2012 and entitled "Multi-Window Lateral Well Locator/Reentry Apparatus and Method" and is incorporated herein in its entirety by express reference. Additionally, a prior art running tool assembly for a lateral well locator are commercially available from Knight Oil Tools under the name "X-Finder".

SUMMARY OF THE INVENTION

In one embodiment, an apparatus for locating a top and bottom of lateral well windows in a wellbore is disclosed. The apparatus includes a running tool assembly having a proximal end and a distal end, wherein the running tool is connected to a work string at the proximal end, wherein the running tool assembly an inner bore being located at the distal end of the running tool, with the running tool assembly having a cavity having a first portion adjacent the proximal end of the running tool and a second portion adjacent the distal end of said running tool, and wherein the inner bore is communicated with the second portion of the cavity. The apparatus further comprises a swing arm including a locating head profile, with the swing arm having a proximal end pivotally attached to the running tool and a distal end adjacent the inner bore, wherein the swing arm has a retracted position within the cavity and an extended position from the cavity, and wherein the distal end of the swing arm contains a shearing surface. The apparatus may further include a biasing member partially disposed within the inner bore; a shear rod having a plurality of individual shear groove segments, with the shear rod being partially disposed within the inner bore, with the shear rod operatively associated with the biasing member, wherein the biasing member biases the shear rod into the direction of the cavity, and wherein the shearing surface is configured to engage and shear the individual shear groove segments during pivoting of the swing arm from the extended position to the retracted position thereby locating the top and bottom of the lateral well windows.

The locating head profile, in this embodiment, comprises a protuberance on an outer section of the swing arm and wherein the protuberance is responsive to the lateral well windows so that the swing arm extends when the top of the lateral well window is encountered and wherein the swing arm retracts when the bottom of the lateral well window is encountered and wherein the extension of the swing arm allows the shearing rod to extend a predetermined distance and the retraction of the swing arm engages the shearing surface with the individual shear groove segments so that the shearing rod is sheared at the individual shear groove segments when the bottom of the lateral well window is encountered.

In one embodiment, the individual shear groove segments comprise circumferential shear grooves placed about the shear rod in a series which allows the advancing and shearing of the individual shearing groove segments in separate, multiple cycles. The shear rod may contain six circumferential shear grooves so that the apparatus can locate six lateral well windows. The shearing surface may comprise a first surface extending perpendicular from a second surface. Also, the shearing rod may contain a loading groove, and the running tool may have an opening, and the apparatus further includes a fastener member fitted within the opening in the running tool and operatively associated with the loading groove to position and bias the shearing rod in position relative to the swing arm. In one embodiment, the fastener member comprises a wing nut having a shaft disposed within the opening, and wherein the shaft engages the loading groove.

A method for locating multiple lateral well windows in a wellbore is also disclosed. The method includes placing a running tool assembly in the wellbore, with the running tool connected to a work string at a proximal end, wherein the running tool contains an inner bore being configured on a lower portion of the running tool, with the running tool having a cavity portion therein, encountering a top of a first lateral well window and allowing a spring positioned within the cavity to act against a swing arm pivotally contained within the cavity to bias the swing arm in an extended position. The method may also comprise biasing a shear rod into the cavity portion with a shear rod biasing member, wherein the shear rod biasing member is partially disposed within the inner bore; abutting a first individual groove segment contained on the shear rod against a shearing surface located on a distal end of the swing arm. encountering a bottom of the first lateral well window. and contacting a locator head profile formed on the swing arm with the bottom of the window of the first lateral well. The method may also include creating a force against the first individual groove segment by the shearing surface, shearing-off the first individual groove segment and retracting the swing arm into the cavity portion. In one embodiment, the method further comprises encountering a top of a second lateral well window, allowing the spring within the cavity to act against the swing arm to bias the swing arm to the extended position, biasing the shear rod into the cavity portion with the shear rod biasing member, abutting a second individual groove segment contained on the shear rod against the shearing surface and encountering a bottom of the second lateral well window. The method may further include contacting the locator head profile on the bottom of the second lateral well window, creating a force against the second individual groove segment by the shearing surface, shearing-off the second individual groove segment, and retracting the swing arm into the cavity.

In one embodiment, the shear rod contains a loading groove and the method further includes fitting a fastener member within an opening in the running tool operatively associated with the loading groove, and wherein the step of placing the running tool and the guide member in the wellbore includes utilizing the fastener member at the surface of the wellbore to load the shear rod within the inner bore of the running tool. The method may also include encountering a top of a third lateral well window, allowing the spring within the cavity to act against the swing arm contained within the cavity to bias the swing arm in the extended position, biasing the shear rod into the cavity with the shear rod biasing member, abutting a third individual groove segment contained on the shear rod against the shearing surface, encountering a bottom of the third lateral well window, and contacting the locator head profile on the bottom of the third lateral well window. Next, the method comprises creating a force against the third individual groove segment by the shearing surface, shearing-off the third individual groove segment, and retracting the swing arm into the cavity. In one embodiment, the shear rod biasing member is a coiled spring. In another disclosed embodiment, the shear rod biasing member is a pressurized well fluid communicated from the wellbore via a port in the running tool. In yet another disclosed embodiment, the shear rod biasing member is a pressurized cylinder operatively positioned with the inner bore and configure to deliver pressure to the shear rod thereby biasing the shear rod. Also, as per the teachings of this disclosure, in one embodiment, the step of allowing the spring positioned within the cavity to act against the swing arm and extending the swing arm includes locating the sides of the lateral well by turning the work string by rotating the work string and contacting the extended locator head profile with the sides of the first lateral window.

In yet another disclosed embodiment, an apparatus for locating multiple windows in a wellbore is disclosed. The apparatus is run into the wellbore on a work string, wherein the windows are associated with lateral wells. The apparatus may comprise: a convex running tool connected to the work string, wherein the running tool contains an inner bore being located at a distal end of the running tool; a concave guide member connected to a segment of the distal end of the running tool, the guide member containing an angled concave surface, wherein the guide member is configured to allow operations within the lateral well; a swing arm having at one end a locating head, the swing arm being pivotally attached within an inner cavity of the running tool, wherein the locating head having a first retracted position within the running tool and a second extended position extending from the running tool, and wherein the locating head contains a shearing surface at an aft end; a biasing member disposed within the inner bore, with the biasing member configured to create a force in the direction of the locating head; a shearing rod operatively positioned within the inner bore and engaging a first end of the biasing member so that the shearing rod extends from the inner bore in the direction out of the inner bore towards the locating head, wherein the shearing rod contains a series of circumferential, individual grooves; and wherein the shearing surface is configured to engage and shear the individual grooves of the shearing rod at a predetermined force in multiple, individual cycles.

In one embodiment, the locating head is responsive to the window associated with a lateral well within the wellbore so that the locating head extends when the opening portion of the window is encountered and wherein the locating head retracts when the closing portion of the window is encountered and wherein the extension of the head allows the shearing rod to extend a predetermined distance and the retraction of the locating head engages the shearing surface with individual grooves of the shearing rod. Hence, the shearing rod is sheared at the individual groove thereby allowing the locating of the window and positioning the head back into the retracted position within the cavity of the running tool. The biasing member may be a conical spring.

In one preferred embodiment, the shearing rod contains a loading groove, and the running tool has disposed there through an opening operatively associated with the loading groove, and the apparatus further includes a wing nut fitted within the opening in the running tool to position and load the shearing rod in position relative to the locating head. The shearing surface may be configured to allow the advancing and shearing of individual grooves in separate, multiple cycles.

The present disclosure provides for a reliable, cost-effective means to locate and reenter multiple lateral wells contained within a single, main wellbore. Additionally, the disclosure allows an operator to find multiple windows in a single wellbore without having to pull out of the hole with the work string between the identification of each window.

DETAILED DESCRIPTION OF THE PREFERRED EMBODIMENT

Figure 1A:
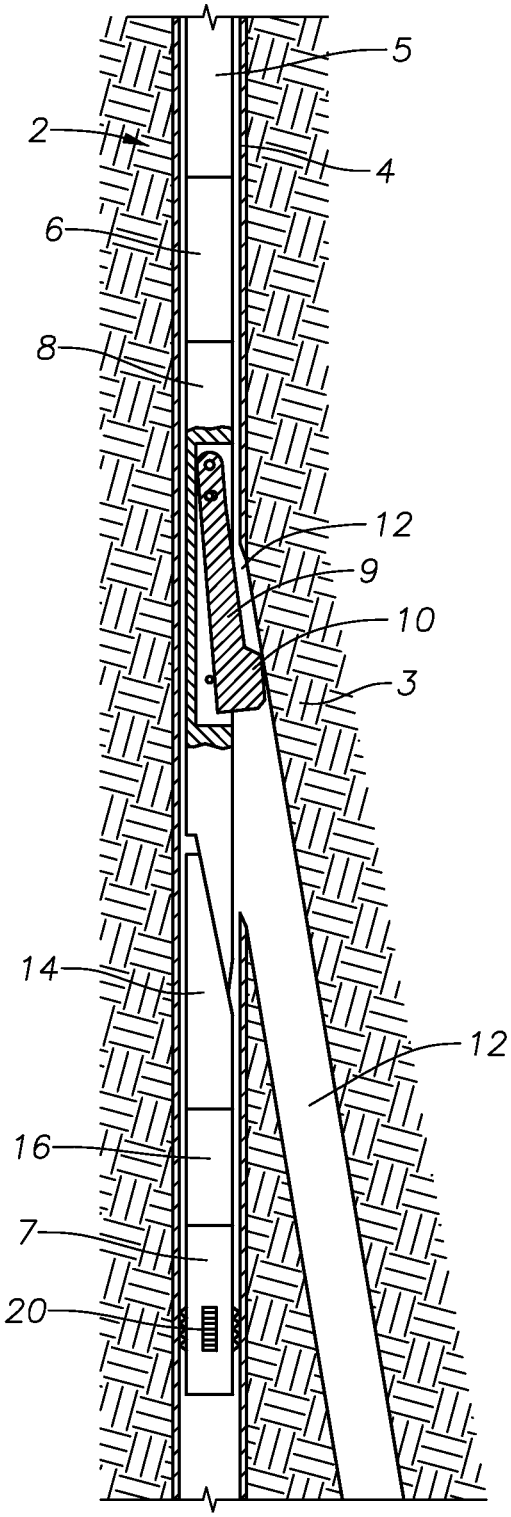
FIG. 1A is a perspective view of the window finder apparatus disposed within a subterranean zone.
Figure 7:
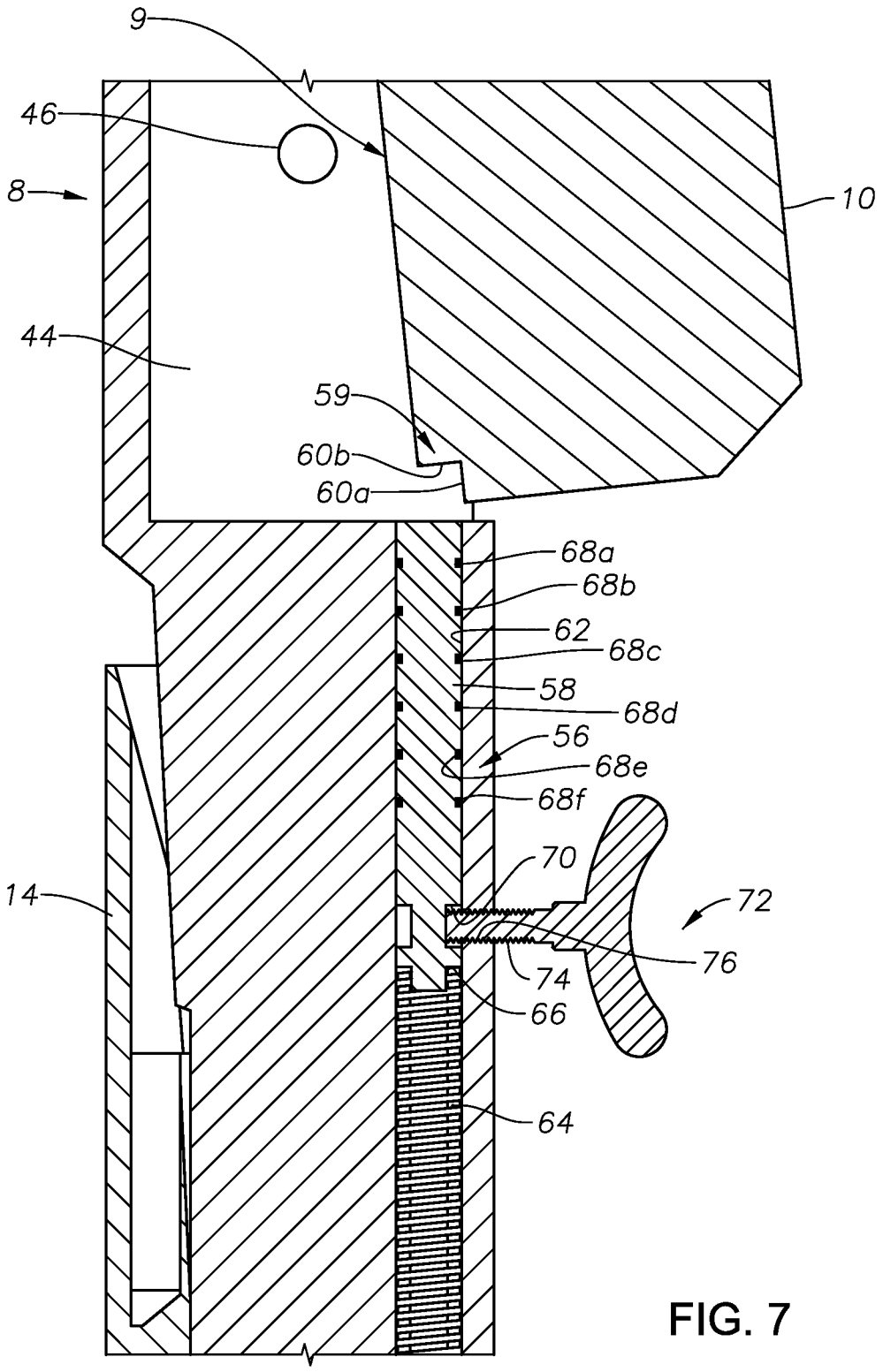
FIG. 7 is a partial cross-sectional view of one embodiment of the shear rod assembly of the present disclosure in the loading position.
Figure 8A:
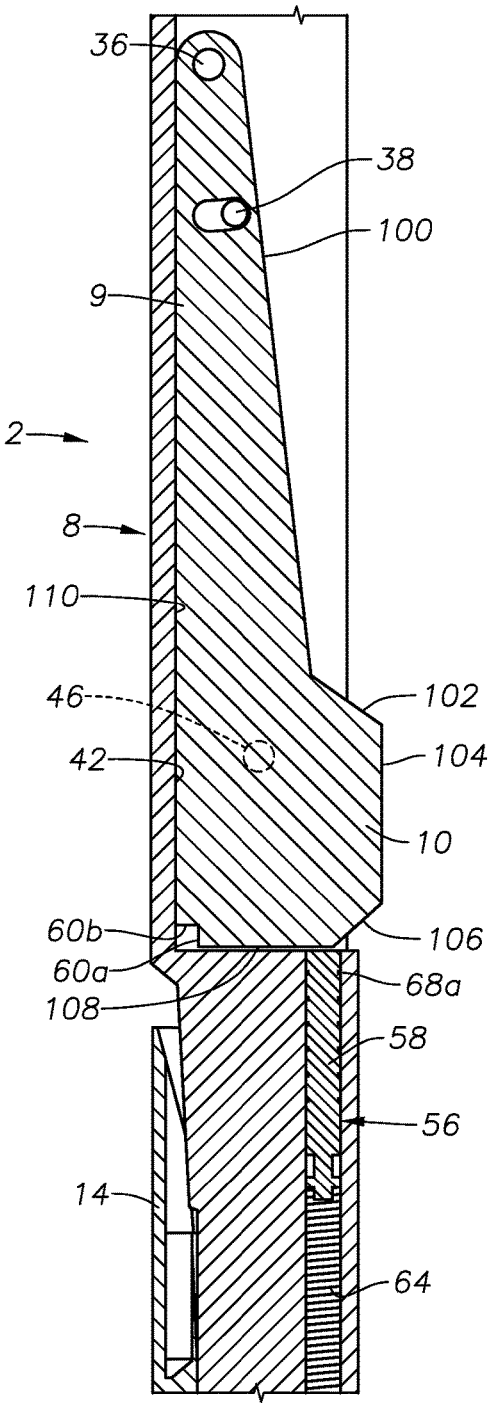
FIG. 8A is a partial cross-sectional view of one embodiment of the shear rod assembly of FIG. 7 in the first cycle of the loaded position.

Referring now to FIG. 1A, a perspective view of the window finder apparatus 2 of the present disclosure disposed within a subterranean zone 3 will now be described. FIG. 1 illustrates the well casing 4, which may be in one exemplary embodiment 5½" casing, and includes the apparatus 2 disposed therein. The apparatus 2 is lowered into the well casing 4 on a work string such as drill pipe 5, wherein the apparatus 2 is attached to the diverter sub 6, which allows for a ball, such as a ⅞" ball, to be dropped into the ball seat to activate the setting of a hydraulic anchor 7. The apparatus 2 includes the convex running tool 8 which has operatively attached a pivoting swing arm 9 having a locator head profile 10 (also referred to as locating head 10). As seen in FIG. 1A, the head 10 has extended into, and thus located, a first window 12. In one embodiment, the first window 12 may be a 4¾" diameter well. FIGS. 1 through 6 depict the general apparatus 2 as well as the general operation of the apparatus 2 while the FIGS. 7 through 9 depict the preferred embodiments of this disclosure.

Figure 1B:
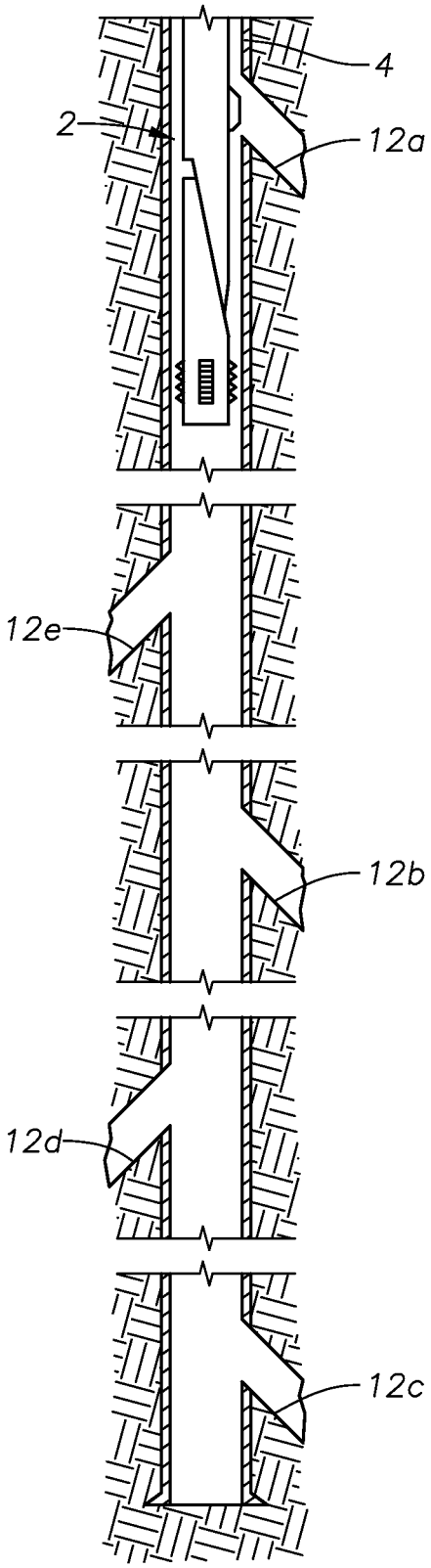
FIG. 1B is an illustration of multiple windows extending from a well casing.

FIG. 1A depicts the running tool 8 being operatively attached, such as by shear bolt means, to the concave guide member 14, such as a 4½" outer diameter guide member which in turn is operatively attached to the debris sub and cup means 16. As seen in FIG. 1A, the hydraulic anchor 7 is attached to the debris sub and cup means 16 which in turn is operatively connected to the anchor slips 20 of the hydraulic anchor 7. As used in this description, the running tool 8 and guide member 14 may be referred collectively as the running tool assembly. FIG. 1B depicts an embodiment wherein multiple windows extending from the well casing 4, such as windows 12*a*, 12*b*, 12*c*, 12*d*, and 12*e*.

Figure 2:
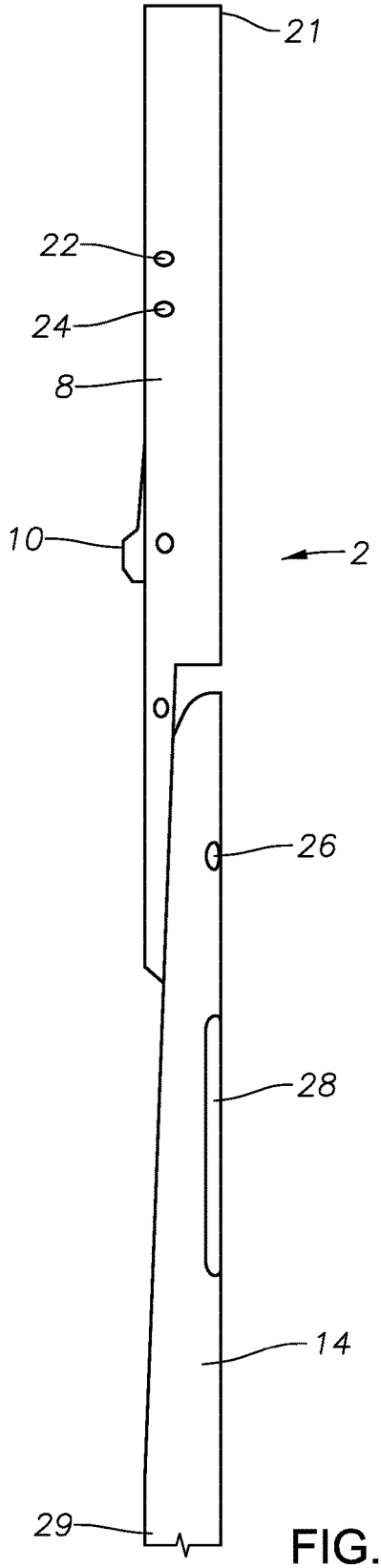
FIG. 2 is a perspective view of one embodiment of the window finder apparatus herein disclosed.

Referring now to FIG. 2, a perspective view of one embodiment of the window finder apparatus 2 which will be attached to the work string (work string not shown in this view), and in particular the running tool 8 and the guide member 14 is illustrated. FIG. 2 depicts the box end 21 which will be attached to the work string and may be a 2⅞" box end 21, the bolt 22 that holds the swing arm hinge pin in the running tool 8 and the bolt 24 that holds the head travel pin in place (the pins will be described later in the disclosure). FIG. 2 also depicts the shear bolt 26 (which holds the running tool 8 to the guide member 14), wherein the shear bolt 26 is set at a predetermined shear force which in one embodiment is between 15,000 to 28,000 pounds; it should be noted that in some tools, such as smaller diameter tools, the shear bolt may be sized to shear at about 10,000 pounds, while in other tools, the shear bolt may be sized to shear as high as 45,000 pounds or more, as understood by those of ordinary skill in the art. It should also be noted that after the windows are located, and anchors set, the operator will detach the running tool 8 from the guide member 14 via shearing and the operator will pull out of the well with the work string and running tool 8. FIG. 2 further depicts the retrieval slot 28 for retrieval of the guide member 14 from the well, as understood by those of ordinary skill in the art. The guide member 14 may have a 4½" outer diameter and a 2⅞" pin end 29 for make-up to the remainder of the bottom hole assembly which includes the debris sub, hydraulic anchor and anchor slips, which are not seen in this view.

Figure 3:
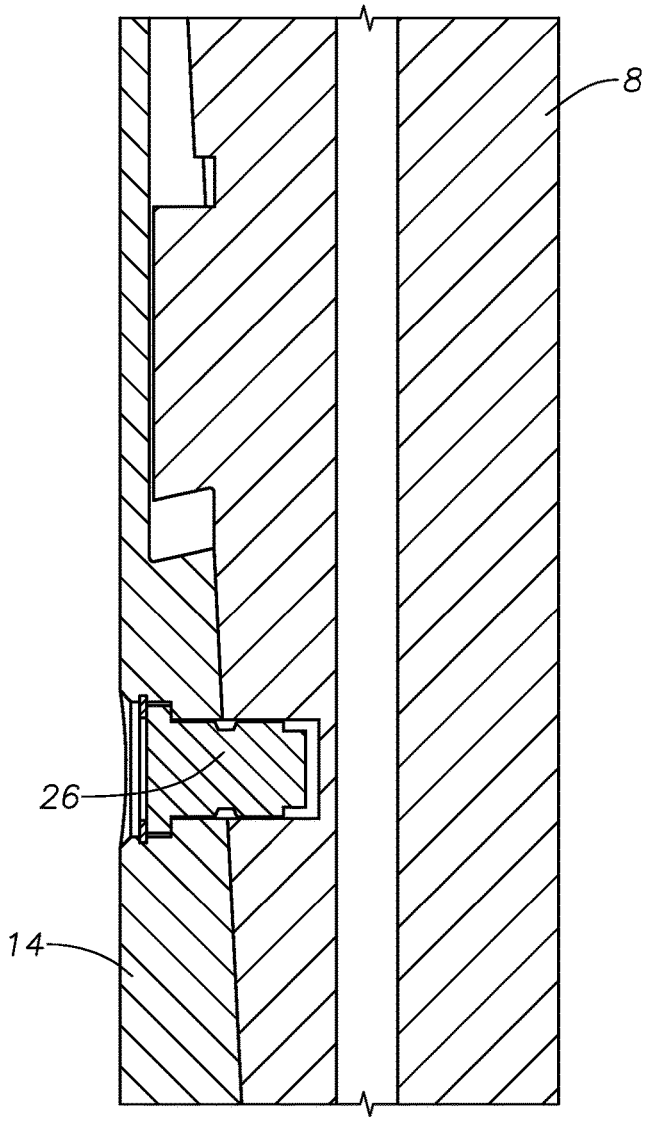
FIG. 3 is a partial cross-sectional view of the concave/convex dovetail portion of the window finder apparatus.

FIG. 3 is a partial cross-sectional view of the concave/convex dovetail portion of the window finder apparatus 2. More specifically, FIG. 3 illustrates the running tool 8 which is pinned to the guide member 14 via shear bolt 26 in a dovetail manner. The dovetail connection between the guide member 14 and the running tool 8 will prevent: the running tool 8 from going into the window after the shear bolt 26 has sheared; wedging between concave guide member 14 and the running tool 8 which will keep the anchor 7 from being pulled/released prematurely; and, the stinger from coming out of line with the seal bore in the concave guide member 14. Note that it is possible to reduce shear when the apparatus 2 is run in a well with coiled tubing, since coiled tubing may require an upward shear force, as understood by those of ordinary skill in the art.

Figure 4:
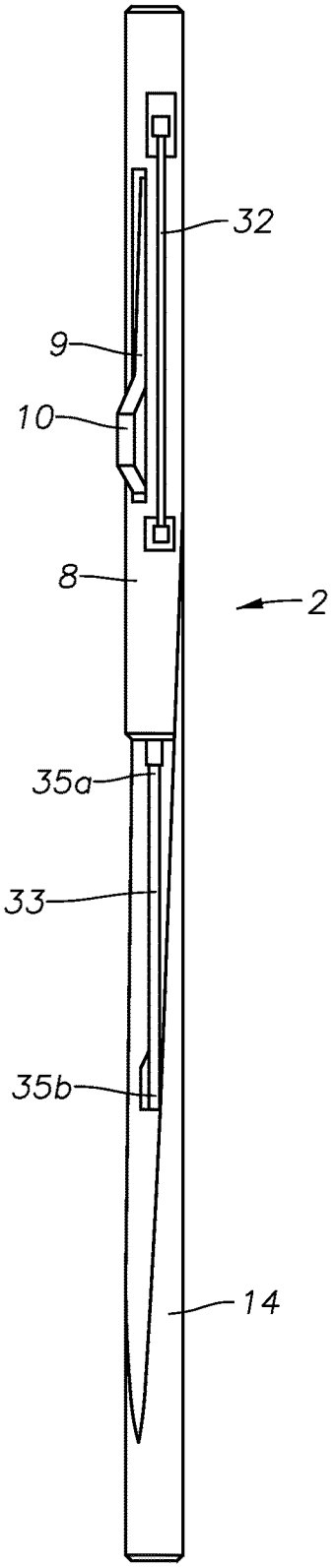
FIG. 4 is a partial cross-sectional view of the hydraulic means of the window finder apparatus.

FIG. 4 is a perspective view of the hydraulic means of the window finder apparatus 2. The diverter sub 6 with a port, which in one embodiment is a ⅝" port, will be mounted above the running tool 8, which above that may be mounted a RT indexing tool for use with a coiled tubing if coiled tubing is utilized. The purpose of the RT indexing tool is for rotational orientation. The RT indexing tool is commercially available from RT Manufacturing under the name RT Indexing Tool. The line 32 is used to divert hydraulic fluid around the swing arm 9 and the window locating head 10. For exemplary purposes only, a ½" outer diameter×⅜" inner diameter hydraulic tubing may be used as line 32. The 1" NPT stinger pipe 33 with an O-ring nose segment 35*a* is shown, and wherein the stinger 33 will supply hydraulic fluid to operate the anchor 7 (not shown in this figure) positioned at the bottom end of the apparatus 2. An O-ring nose 35*b* will seal to the bore in the guide member 14. The stinger 33 is connected to the running tool 8 and will slip out of the seal bore when the running tool 8 is pulled from the well. FIG. 4 also depicts the spring loaded swing arm 9 with window locating head 10. Although not shown in FIG. 4, the debris sub 16 and anchor 7 will be connected as previously discussed.

Figure 5:
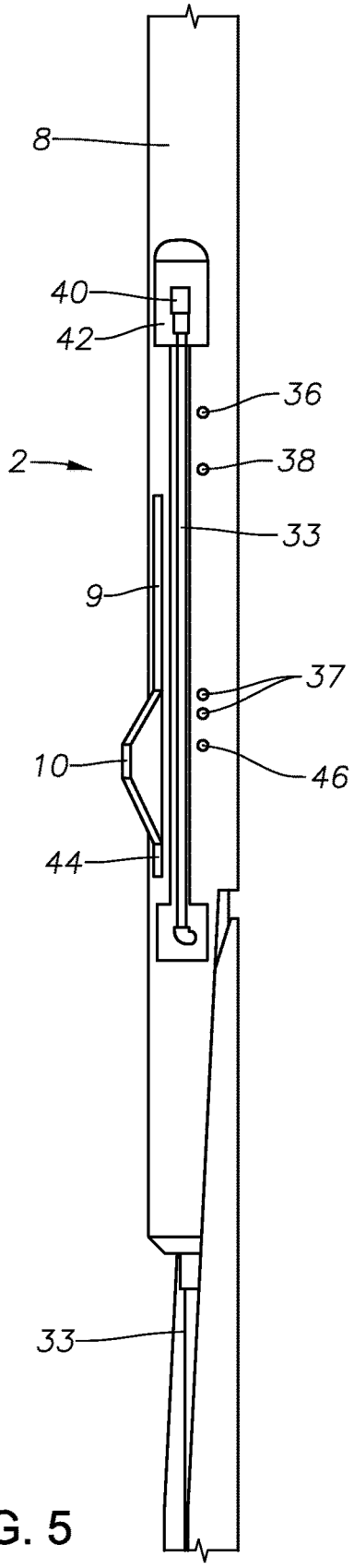
FIG. 5 is a partial cross-sectional view of the window finder apparatus depicting the shear pin sequence arrangement.

Referring now to FIG. 5, a partial illustration view of the window finder apparatus 2 depicting the shear pin sequence arrangement will be discussed. The hinge pin and hole, seen generally at 36, for the pivotally mounted swing arm 9 is shown, along with the head travel pin and pin hole, seen generally at 38, wherein the head travel pin 38 limits how far the swing arm 9 and the window locating head 10 can travel out of body of the running tool 8 as will be further explained below. FIG. 5 also depicts the special swivel hydraulic fitting 40, wherein all fittings and tubing will be covered by a cover plate 42. In one exemplary embodiment, FIG. 5 depicts the head 10 coming out 1½" out of the 4½" outer diameter running tool 8 giving a 6" cross-section. In this exemplary embodiment, the shear pin 37 holds the head at 5½" cross-section while traveling to the 5½" casing. Once the head 10 comes into contact with the 5½" casing inner diameter (which is smaller than the 5½" cross-sectional area of the running tool 8), the shear pin 37 will shear and allow the swing arm 9 and head 10 to collapse into the cavity, seen generally at 44, of the running tool 8 and travel down the well to the window. When the head 10 locates the window, the head 10 will be forced out by the lateral springs located in the swing arm 9. The lateral springs are operatively associated with the spring arm 9 and will be described later in the disclosure. At this point, the head 10 will be opened to a 6" cross-section. Once the swing arm 9 with the head 10 travels into the window, a spring loaded shear pin 46 will extend and prevent the head 10 from being able to close. The head 10 will be located out in the window until a force greater than the spring loaded shear pin 46 is applied (which in one embodiment is 10,000 pounds). Once the head 10 contacts the bottom of the window, and a predetermined amount of weight is applied (i.e. over 10,000 pounds), the spring loaded shear pin 46 will shear and the swing arm 9 and head 10 can retract. In the embodiment of FIG. 5, the 1" NPT stinger pipe 33 will be exposed within the well i.e. no cover plate is included in this embodiment.

Figure 6:
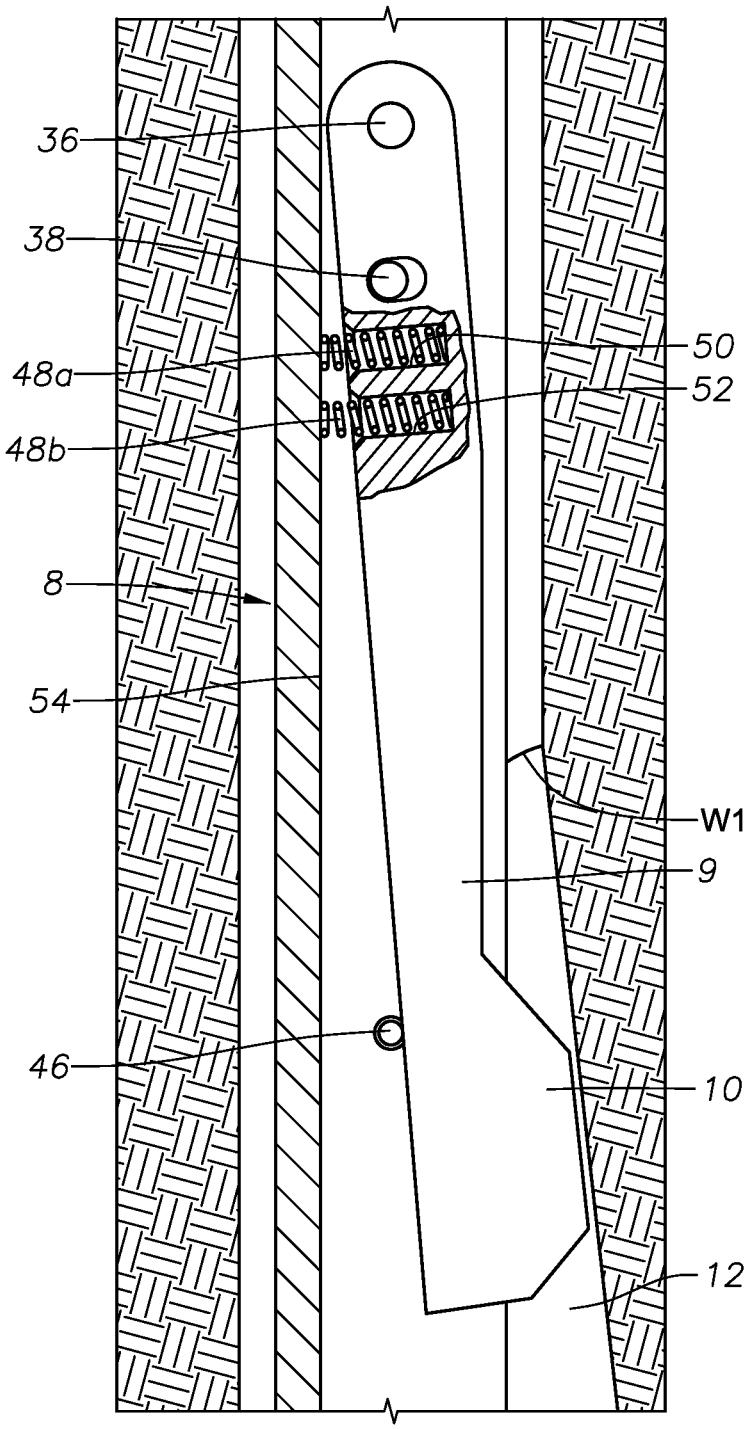
FIG. 6 is a partial cross-sectional view of the head with attached swing arm entering a window.

FIG. 6 is a partial cross-sectional view of the head 10 with attached swing arm 9 entering a first window 12. Note that in FIG. 6 the start of the window is at W1. The lateral springs 48*a* and 48*b* will be installed in the holes 50 and 52. In one embodiment, the springs 48*a* and 48*b* are coiled springs. The springs 48*a* and 48*b* will act against the inner portion 54 of the running tool 8 which in turn will force the head 10 into the window 12. The spring loaded shear pin 46 (preloaded at 10,000 pounds in one embodiment) will extend and move into place when the head 10 reaches the 6" cross-section measurement. In one embodiment, the shear pin 46 will expand approximately ⅜" and abut the side of the swing arm 9. In the position noted in FIG. 6, the head 10 is at a 6" outer diameter cross-section, and therefore, the spring loaded shear pin 46 has extended into the position seen in FIG. 6.

Referring now to FIG. 7, a partial cross-sectional view of the shear rod assembly, seen generally at 56, of the present disclosure is shown. More specifically, the shearing rod 58 is loaded into the running tool 8 by the operator at the surface. The running tool 8 is shown wherein the locating head 10 is in the extended position. Note the locating head 10 is extended from the cavity 44. The spring loaded shear pin 46 has not yet been loaded within the running tool 8. It should be noted that in the run in the well position, the swing arm 9 with locating head 10 is in the retracted position, with the swing arm 9 within the cavity 44 (the retracted position not shown here). The swing arm 9 has contained thereon a shearing surface 59. As shown in FIG. 7, the shearing surface 59 has two surfaces 60*a*, 60*b* that meet at a right angle in the most preferred embodiment. The individual segments of the shearing rod 58, formed by individual, circumferential grooves, will be sheared by the shearing surface 59 in individual cycles as will be more fully explained below.

The shearing rod 58 is disposed within the inner bore 62 (also referred to as the shear rod bore 62) of the running tool 8. The inner bore 62 extends from the bottom portion of the cavity 44. It should be noted that as used in this disclosure, the top and bottom are relative terms for a tool used in a well, and the top refers to the position closer to the surface and the bottom refers to the position farther from the surface. FIG. 7 also depicts the biasing member 64 that will engage with the collar end 66 of the shearing rod 58, wherein the biasing member 64 is disposed within the inner bore 62. Hence, the biasing member 64, which may be a coiled spring 64 in one embodiment seen in FIG. 7, engages and biases the collar end 66 of the shearing rod 58. In one embodiment, the shearing rod 58 will have a series of individual, circumferential grooves, seen for instance at groove 68*a*. A total of six (6) grooves are provided in the shearing rod 58 of FIG. 7. More particularly, grooves 68*a*, 68*b*, 68*c*, 68*d*, 68*e*, 68*f* are depicted. It should be noted that the number of grooves can vary depending on several factors including, but not limited to, the size of the running tool assembly.

Also, the shearing rod 58 will have a loading groove 70 for cooperation and engagement with the wing nut means 72. The wing nut means 72 will be utilized by the operator at the surface. The operator will compress the spring 64 into the inner bore 62 with the shearing rod 58 also being disposed within the inner bore 62. The operator can then can insert the wing nut means 72 into engagement with the loading groove 70. The wing nut means 72 includes a threaded shaft 74 that engages a threaded opening 76 in the side wall and in communication with the inner bore 62 of the running tool 8, wherein the shaft 74 will in turn engage the loading groove 70 as seen in FIG. 7. In this way, the shearing rod 58 is held down against the force of the spring 64. When the operator rigs-up the shearing rod 58 at the surface, the spring 64 has been compressed and the shaft's 74 engagement with the loading groove 70 holds the spring 64 and shearing rod 58 in the loaded position as seen in FIG. 7. The operator can then pivot the swing arm 9 (and head 10) back into the cavity 44. Hence, FIG. 8A depicts the partial cross-sectional view of one embodiment of the shear rod assembly 58 of FIG. 7 in the first cycle of the loaded position, and FIG. 8 represents the run in the well position of the apparatus 2. The shear rod assembly 56 includes the shear rod, grooves, biasing member, collar end, and loading groove. The swing arm 9 and locating head 10 may be held in this contracted position by shear bolt/pin means, or alternatively, by the inner diameter of the casing string. More specifically, and as previously mentioned, one set of shear pins (pin 37 seen in FIG. 5) holds the swing arm out at about 5½" outer diameter cross-section and when encountering 5½" casing, the pin 37 will shear because of the smaller inner diameter; and another set (the head travel shear pin 38 also seen in FIG. 5) limits the swing arm 9 from expanding more than a 6" outer diameter cross-section. Note that the spring loaded shear pin 46 has not extended as depicted in FIG. 8 because the swing arm 9 is holding the spring loaded shear pin 46 in the retracted position.

In the embodiment shown in FIG. 8A, the swing arm 9 is shown with hinge pin 36. The swing arm 9 extends on a first angled surface 100 which in turn extends to a second angled surface 102 and then stretches to a vertical surface 104. The surface 104 then stretches to another angled surface 106 which in turn terminates at flat surface 108. The profile of the surfaces 102, 104 and 106 may be referred to as a protuberance. The surface 108 extends to the shearing surfaces 60*a*, 60*b*, which in turn extend to the vertical surface 110. In operation, the angled surface 106 of the locator head 10 will contact the lower end of the window 12, as will be more fully described later. The bottom end 108 of the swing arm 9 will act against a groove (such as groove 68*a*), and the shearing surfaces 60*a*, 60*b* will shear the individual groove segment, such as groove 68*a* seen in FIG. 8A.

Figure 8B:
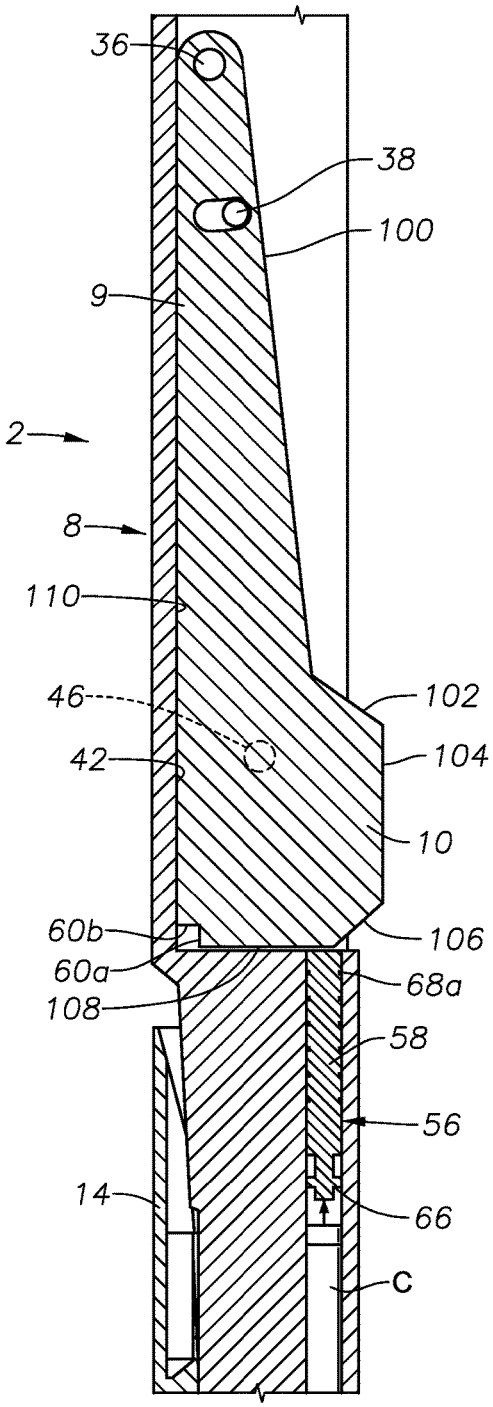
FIG. 8B is a partial cross-sectional view of another embodiment of the shear rod assembly in the loaded position of the first cycle.
Figure 8C:
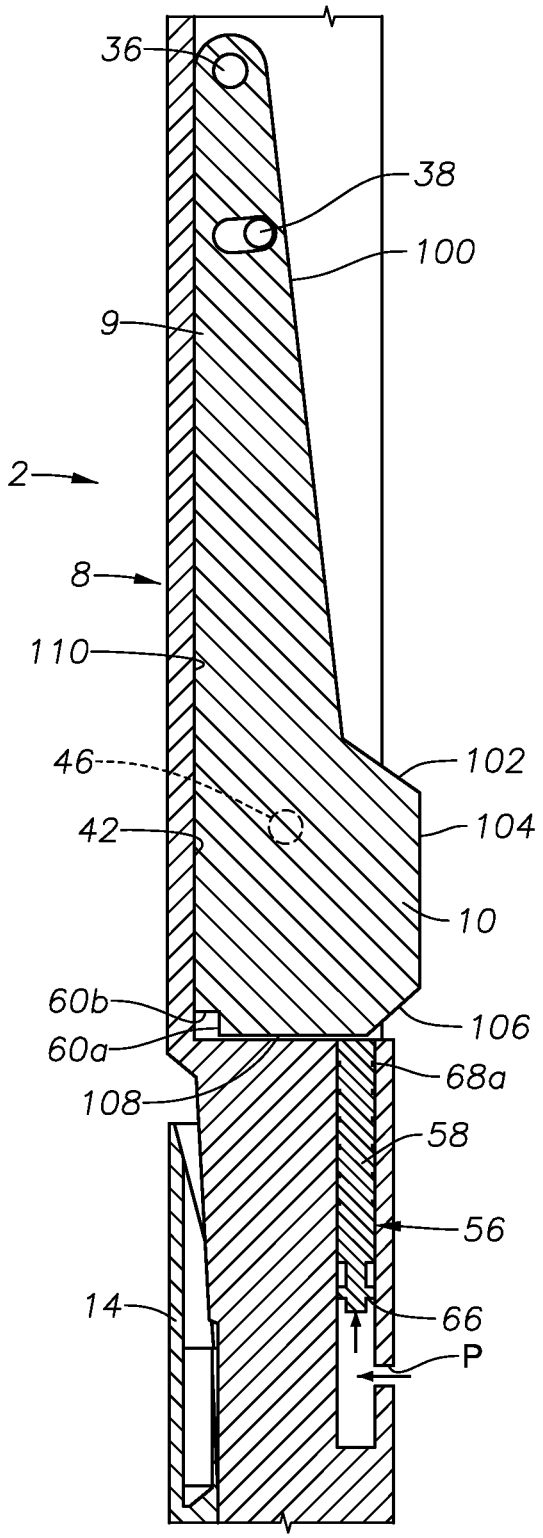
FIG. 8C is a partial cross-sectional view of yet another embodiment of the shear rod assembly in the loaded position of the first cycle
Figure 9:
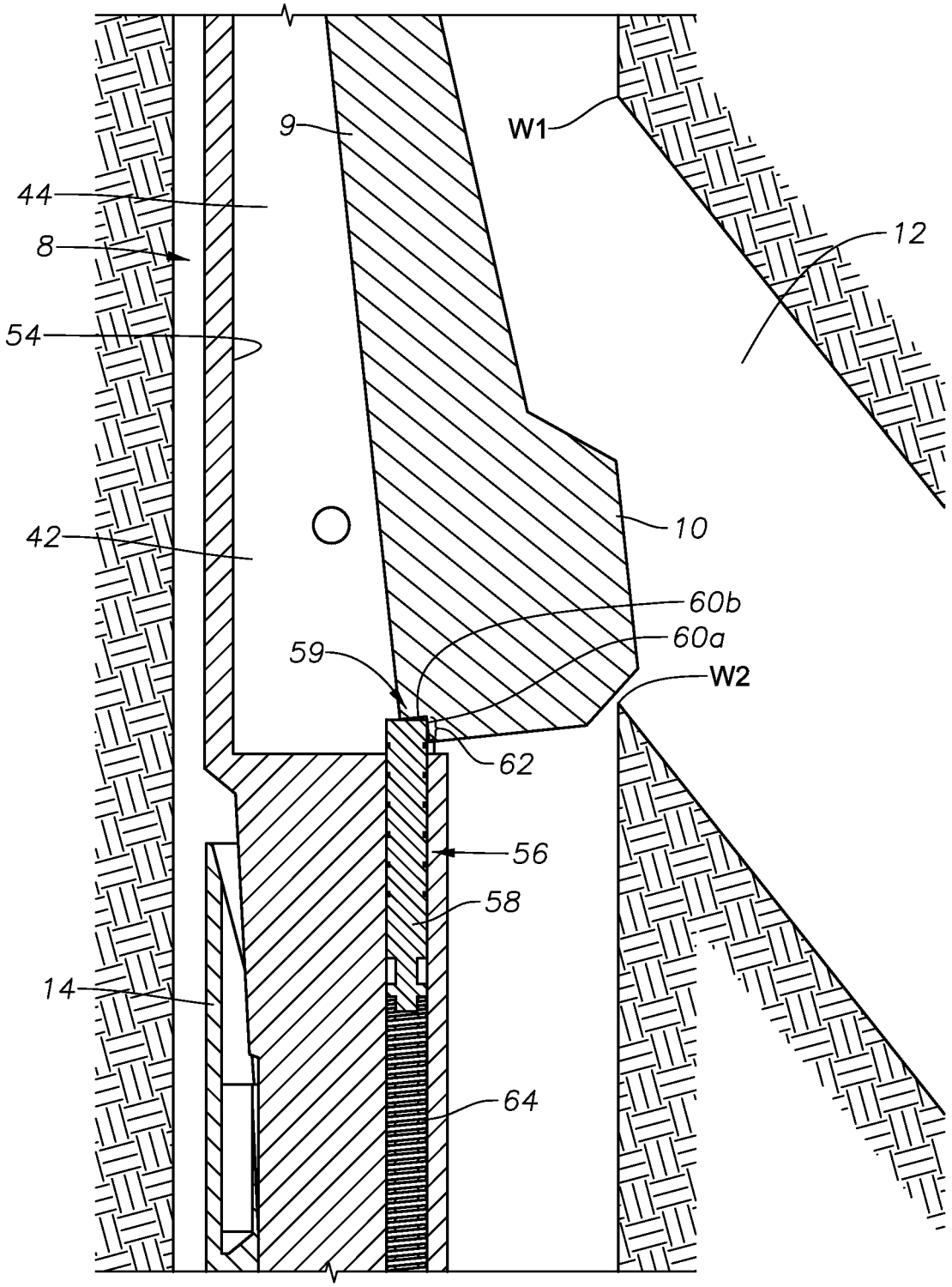
FIG. 9 is a partial cross-sectional view of the shear rod assembly of FIG. 7 in the first shearing cycle.

Referring now to FIG. 8B, a partial cross-sectional view of another embodiment of the shear rod assembly in the loaded position is shown. More particularly, this view depicts the biasing member as a cylinder "C" (also referred to as a canister) of pressurized gas, such as air, to act on the collar end 66 which will provide means for biasing the shear rod 58 into the cavity 44. In FIG. 8C, which is a partial cross-sectional view of yet another embodiment of the shear rod assembly in the loaded position, the biasing member includes a port "P" in the running tool and in communication with the inner bore 62 which provides a pressure path for wellbore fluids/gas to act on the shear rod 58, and in particular on the collar end 66 of the shear rod 58, which will provide means for biasing the shear rod 58 into the cavity 44.

Referring now FIG. 9, a partial cross-sectional view of the shear rod assembly 56 of FIG. 7 in a down hole environment during the first down hole shearing cycle is shown. Thus, the locating head 10 has been allowed to expand to the position seen in FIG. 9 by the lateral springs 48*a*, 48*b* (seen in FIG. 6) on an inner portion 54 of the running tool 8. The spring 64, which is urging the shear rod 58 into the cavity 44 (i.e. upward into the cavity 44), advances the shear rod 58, and in particular the segment 62 into the shearing surfaces 60*a*, 60*b* as seen in FIG. 9. However, in accordance with the present disclosure, as the locating head 10 contacts an interface such as the lower end W2 of the window 12, the locating head 10 will then begin to close (i.e. the head 10 begins to retract). The retraction causes the shearing surfaces 60*a*, 60*b* to move into shearing contact and shear an individual segment of the shearing rod, seen generally at 62. The shearing will occur at a predetermined force based on the shearing rod 58 and the depth of the individual groove, with the amount of the force being selected by the operator. The sheared off segment 62 will fall into the cavity 44.

Once the segment 62 is sheared off, the locating head 10 will continue to retract into the cavity 44 as seen in FIG. 8. In other words, the first cycle has now been completed which has allowed the operator to find the beginning of the window and the ending of the window. As per the teaching of this disclosure, another shearing cycle can begin. In the embodiment shown, the shearing rod 58 has a total of six cycles which corresponds to the six grooves 68*a*, 68*b*, 68*c*, 68*d*, 68*e*, 68*f*. Therefore, with the embodiment shown, a total of six windows could be located or the conformation of the depth of the top or bottom of the windows.

Also, the sides of the lateral window may be located, as per the teachings of this disclosure. Thus, the sides of the lateral window may be located by turning the locator head 10 (once the head has expanded in a window) by rotating the work string. More particularly, the work string can be turned at the surface, by a wrench for instance, and the head 10 will contact the sides of the lateral well window thereby providing the operator with the size of the window. In other words, by turning the work string to the right or left, the width of the window can be determined.

Although the present invention has been described in considerable detail with reference to certain preferred versions thereof, other versions are possible. Therefore, the spirit and scope of the appended claims should not be limited to the description of the preferred versions contained herein.

We claim:

1. An apparatus for locating a top and bottom of lateral well windows in a wellbore, wherein the apparatus is run into the wellbore on a work string, the apparatus comprising:

a running tool assembly having a proximal end and a distal end, wherein said running tool is connected to the work string at the proximal end, wherein the running tool contains an inner bore being located at the distal end of said running tool, said running tool having a cavity having a first portion adjacent the proximal end of said running tool and a second portion adjacent the distal end of said running tool, and wherein said inner bore is communicated with said second portion of said cavity;

a swing arm including a locating head profile, said swing arm having a proximal end pivotally attached to said running tool and a distal end adjacent said inner bore, wherein said swing arm having a retracted position within said cavity and an extended position from said cavity, and wherein said distal end of said swing arm contains a shearing surface;

a biasing member partially disposed within said inner bore;

a shear rod having a plurality of individual shear groove segments, said shear rod being partially disposed within said inner bore, said shear rod operatively associated with said biasing member, wherein said biasing member biases said shear rod into the direction of the cavity;

wherein said shearing surface is configured to engage and shear the individual shear groove segments during pivoting of said swing arm from the extended position to the retracted position thereby locating the top and bottom of the lateral well windows; and wherein said shearing rod contains a loading groove, and said running tool has disposed there through an opening, and the apparatus further includes a fastener member fitted within the opening in the running tool and operatively associated with said loading groove to position and bias the shearing rod in position relative to said swing arm.

2. The apparatus of claim 1 wherein said locating head profile comprises a protuberance on an outer section of said swing arm and wherein said protuberance is responsive to the lateral well windows so that said swing arm extends when the top of the lateral well window is encountered and wherein the swing arm retracts when the bottom of the lateral well window is encountered and wherein the extension of the swing arm allows the shearing rod to extend a predetermined distance and the retraction of the swing arm engages the shearing surface with said individual shear groove segments so that the shearing rod is sheared at said individual shear groove segments when the bottom of the lateral well window is encountered.

3. The apparatus of claim 1 wherein the biasing member is a coiled spring.

4. The apparatus of claim 3 wherein said individual shear groove segments comprise circumferential shear grooves placed about said shear rod in a series which allows the advancing and shearing of said individual shearing groove segments in separate, multiple cycles.

5. The apparatus of claim 3 wherein said shear rod contains six circumferential shear grooves for locating six lateral well windows.

6. The apparatus of claim 5 wherein said shearing surface comprises:

a first surface extending perpendicular from a second surface.

7. The apparatus of claim 1 wherein said fastener member comprises a wing nut having a shaft disposed within said opening, and wherein said shaft engages said loading groove.

8. A method for locating multiple lateral well windows in a wellbore comprising:

a) placing a running tool assembly in the wellbore, said running tool connected to a work string at a proximal end, wherein the running tool contains an inner bore being configured on a lower portion of the running tool, said running tool having a cavity portion therein;

b) encountering a top of a first lateral well window;

c) allowing a spring positioned within the cavity to act against a swing arm pivotally contained within the cavity to bias said swing arm in an extended position;

d) biasing a shear rod into the cavity portion with a shear rod biasing member, wherein said shear rod biasing members is partially disposed within said inner bore;

e) abutting a first individual groove segment contained on said shear rod against a shearing surface located on a distal end of said swing arm;

f) encountering a bottom of the first lateral well window;

g) contacting a locator head profile formed on said swing arm with the bottom of the window of the first lateral well;

h) creating a force against the first individual groove segment by said shearing surface;

i) shearing-off the first individual groove segment;

j) retracting the swing arm into the cavity portion;

wherein said shear rod contains a loading groove and the method further includes fitting a fastener member within an opening in the running tool operatively associated with said loading groove and wherein the step of placing the running tool and the guide member in the wellbore includes utilizing said fastener member at the surface of the wellbore to load said shear rod within the inner bore of the running tool.

9. The method of claim 8 further comprising:

k) encountering a top of a second lateral well window;

l) allowing the spring within the cavity to act against said swing arm to bias the swing arm to the extended position;

m) biasing the shear rod into the cavity portion with the shear rod biasing member;

n) abutting a second individual groove segment contained on said shear rod against the shearing surface;

o) encountering a bottom of the second lateral well window;

p) contacting the locator head profile on the bottom of the second lateral well window;

q) creating a force against the second individual groove segment by said shearing surface;

r) shearing-off the second individual groove segment;

s) retracting the swing arm into the cavity.

10. The method of claim 9 further comprising:

t) encountering a top of a third lateral well window;

u) allowing the spring within the cavity to act against said swing arm contained within the cavity to bias said swing arm in the extended position;

v) biasing the shear rod into the cavity with the shear rod biasing member;

w) abutting a third individual groove segment contained on said shear rod against said shearing surface;

x) encountering a bottom of the third lateral well window;

y) contacting the locator head profile on the bottom of the third lateral well window;

z) creating a force against the third individual groove segment by said shearing surface;

aa) shearing-off the third individual groove segment;

bb) retracting the swing arm into the cavity.

11. The method of claim 10 wherein the shear rod biasing member is a coiled spring.

12. The method of claim 10 wherein the shear rod biasing member is a pressurized well fluid communicated from the wellbore via a port in the running tool.

13. The method of claim 10 wherein the shear rod biasing member is a pressurized cylinder operatively positioned with said inner bore and configure to deliver pressure to said shear rod thereby biasing said shear rod.

14. The method of claim 8 wherein the step of allowing the spring positioned within the cavity to act against the swing arm and extend the swing arm includes locating the sides of the lateral well by turning the work string by rotating the work string and contacting the extended locator head profile with the sides of the first lateral window.

15. An apparatus for locating a top and bottom of a lateral well window in a wellbore, wherein the apparatus is run into the wellbore on a work string, the apparatus comprising:

a running tool having a proximal end and a distal end, wherein said running tool is connected to the work string at the proximal end, wherein the running tool contains an inner bore being located at a distal end of said running tool, said running tool having a cavity portion in communication with said inner bore;

a guide member operatively associated with said running tool;

a swing arm including a protuberance, said swing arm having a proximal end pivotally attached to said running tool and a distal end adjacent said inner bore, wherein said swing arm having a retracted position within said cavity and an extended position from said cavity, and wherein said distal end of said swing arm contains a shearing surface;

a biasing member partially disposed within said inner bore, said biasing member configured to create a force in the direction of the cavity;

a shear rod having a plurality of individual shear grooves, said shear rod being partially disposed within said inner bore, said shear rod operatively associated with said biasing member, wherein said biasing member biases said shear rod into the cavity portion;

wherein said shearing surface is configured to engage and shear an individual shear groove segment formed by said individual shear grooves during pivoting of said swing arm from the extended position to the retracted position thereby locating the top and bottom of the lateral well window; and wherein said shearing rod contains a loading groove, and said running tool has disposed there through an opening operatively associated with said loading groove, and the apparatus further includes a fastener member fitted within the opening in the running tool and operatively associated with said loading groove to position and bias the shearing rod in position relative to said swing arm.

16. The apparatus of claim 15 wherein the biasing member is a coiled spring.

17. The apparatus of claim 15 wherein said individual shear grooves comprises a first circumferential groove placed about said shear rod for locating a first lateral window.

18. The apparatus of claim 17 wherein said individual shear grooves further comprises a second circumferential groove placed about said shear rod for locating a second lateral well window.

19. The apparatus of claim 18 wherein said shearing surface comprises:

a first surface extending perpendicular from a second surface.

20. The apparatus of claim 19 wherein said fastener member comprises a wing nut having a shaft disposed within said opening, and wherein said shaft engages said loading groove.

21. The apparatus of claim 15 wherein said shear rod contains six individual shear grooves for locating six lateral well windows.

22. The apparatus of claim 15 wherein said biasing member is a well fluid pressure communicated from the wellbore into the inner bore via a port in the running tool.

23. The apparatus of claim 15 wherein said biasing member is a pressurized cylinder disposed within said inner bore.

24. An apparatus for locating a lateral well window in a wellbore, wherein the apparatus is run into the wellbore on a work string, the apparatus comprising:

a running tool assembly having a top end and a bottom end, wherein said running tool is connected to the work string at the top end, wherein the running tool contains an inner bore being located at the bottom end of said running tool, said running tool having a cavity therein, and wherein said inner bore is communicated with said cavity;

a swing arm including a locating head profile, said swing arm having a proximal end pivotally attached to said running tool and a distal end adjacent said inner bore, wherein said swing arm having a retracted position within said cavity and an extended position from said cavity, and wherein said distal end of said swing arm contains a shearing surface;

a biasing member partially disposed within said inner bore, said biasing member configured to create an upward force;

a shear rod having a shear groove, said shear rod being partially disposed within said inner bore, said shear rod operatively associated with said biasing member, wherein said biasing member biases said shear rod into the cavity;

wherein said shearing surface is configured to engage and shear said shear rod at said shear groove during pivoting of said swing arm from the extended position to the retracted position thereby locating the top and bottom of the lateral well window; and wherein said shearing rod contains a loading groove, and said running tool has disposed there through an opening operatively associated with said loading groove, and the apparatus further includes a fastener member fitted within the opening in the running tool and operatively associated with said loading groove to position and bias the shearing rod within said inner bore and in an abutting position relative to said swing arm.

25. The apparatus of claim 24, wherein said locating head profile is responsive to the lateral windows so that said swing arm extends when a top of the lateral well window is encountered and wherein the swing arm retracts when a bottom of the lateral well window is encountered and wherein the extension of the swing arm allows the shearing rod to extend a predetermined distance and the retraction of the swing arm engages the shearing surface with said shear groove so that the shearing rod is sheared at said shear groove when the bottom of the lateral well window is encountered.

26. The apparatus of claim 24, wherein the biasing member is a coiled spring.

27. The apparatus of claim 24 wherein said shearing surface comprises:

a first surface extending perpendicular form a second surface.

28. The apparatus of claim 27 wherein said fastener member comprises a wing nut having a shaft disposed within said opening, and wherein said shaft engages said loading groove.

29. The apparatus of claim 24 wherein said shear rod contains a plurality of shear grooves arranged in series which allows the advancing and shearing of said shearing grooves in separate, multiple cycles for locating the top and bottom of a plurality of lateral well windows.

30. The apparatus of claim 24 wherein said shearing surface is configured to allow the advancing and shearing of individual grooves in separate, multiple cycles.

31. An apparatus for locating multiple windows in a wellbore, wherein the apparatus is run into the wellbore on a work string, wherein the windows are associated with lateral wells, the apparatus comprising:

a convex running tool connected to the work string, wherein the running tool contains an inner bore being located at a distal end of said running tool;

a concave guide member connected to a segment of the distal end of the running tool, the guide member containing an angled concave surface, said guide member configured to allow operations within the lateral well;

a swing arm having at one end a locating head, said swing arm being pivotally attached within an inner cavity of the running tool, wherein said locating head having a first retracted position within the running tool and a second extended position extending from the running tool, and wherein said locating head having a shearing surface at an aft end;

a biasing member disposed within said inner bore, said biasing member configured to create a force in the direction of the locating head;

a shearing rod operatively positioned within said inner bore and engaging a first end of said biasing member so that said shearing rod extends from said inner bore in the direction out of the inner bore towards the locating head, wherein said shearing rod contains a series of circumferential, individual grooves;

wherein said shearing surface is configured to engage and shear said individual grooves of said shearing rod at a predetermined force in multiple, individual cycles; and wherein said shearing rod contains a loading groove, and said running tool has disposed there through an opening operatively associated with said loading groove and the apparatus further includes a wing nut fitted within the opening in the running tool to position and load the shearing rod in position relative to said locating head.

32. The apparatus of claim 31 wherein said locating head is responsive to the window associated with a lateral well within the wellbore so that the locating head extends when the opening portion of the window is encountered and wherein the locating head retracts when the closing portion of the window is encountered and wherein the extension of the head allows the shearing rod to extend a predetermined distance and the retraction of the locating head engages the shearing surface with individual grooves of the shearing rod so that the shearing rod is sheared at the individual groove thereby allowing the locating of the window and positioning the head back into the retracted position within said cavity of said running tool.

33. The apparatus of claim 32 wherein the biasing member is a coiled spring.

* * * * *